United States Patent [19]

Belbel et al.

[11] Patent Number: 4,659,887

[45] Date of Patent: Apr. 21, 1987

[54] SWITCH DEVICE HAVING AN INSULATING SCREEN INSERTED BETWEEN THE CONTACTS DURING BREAKING

[75] Inventors: Elie Belbel, Epinay Sur Seine; Christian Blanchard, Nanterre; André Haury, Le Raincy; Michel Lauraire, Courbevoie, all of France

[73] Assignee: La Telemecanique Electrique, France

[21] Appl. No.: 802,094

[22] Filed: Nov. 25, 1985

[30] Foreign Application Priority Data

Nov. 26, 1984 [FR] France ..... 84 17964

[51] Int. Cl.[4] ..... H01H 33/06

[52] U.S. Cl. ..... 200/151

[58] Field of Search ..... 200/144 R, 148 R, 148 A, 200/151

[56] References Cited

U.S. PATENT DOCUMENTS

| | | | |
|---|---|---|---|
| 4,426,562 | 1/1984 | Kemeny | 200/151 |
| 4,510,360 | 4/1985 | Golub | 200/151 |
| 4,562,323 | 12/1985 | Bebel et al. | 200/151 |

*Primary Examiner*—Mark O. Budd

*Attorney, Agent, or Firm*—William A. Drucker

[57] ABSTRACT

A screened electric switch in which the screen is inserted at high speed between the contacts and in which a mobile shutter with a sealing surface basically fixed relatively to the housing drives the screen with a speed which is a function of the energy of the arc.

This switch is applicable to circuit breaking devices designed to check the rise of short-circuit currents or high steady-state rated currents.

5 Claims, 5 Drawing Figures

SWITCH DEVICE HAVING AN INSULATING SCREEN INSERTED BETWEEN THE CONTACTS DURING BREAKING

BACKGROUND OF THE INVENTION

1. Field of the Invention

The invention relates to a screened electric switch containing in a housing two mutually mobile contacts, suitable control devices to open the switch, a mobile screen and the impelling devices designed to move an edge of this screen rapidly between the contacts, in order to shear the arc striking between the parting contacts between this edge and an insulating surface contained in the housing.

It applies namely, but in no way exclusively, to circuit breaking devices designed to open a line where they are in series, either on transient currents, e.g. during short-circuit inception, or on high-level steady-state currents.

2. Description of the Prior Art

Such switches are already known, e.g. in French patent application No. 83 01749 of Feb. 4, 1983 filed by the Applicant. If the means implemented to cause screen movement are not suitable for the increase rate or the rating of the current to be interrupted, the same quality breaking may not be obtained in each one of the situations where breaking is required.

Hence the purpose of the invention is to provide this type of known switches with suitable means to tailor the screen motion velocity to the energy released by the arc at the moment it strikes between the contacts.

SUMMARY OF THE INVENTION

According to the invention, the aim is attained owing to the fact that the screen, which has an opening through which one of the switch contacts passes, and an insulating mobile shutter to which it is joined, move at the same time within a cavity of the body so as to enclose between themselves and the surfaces of this cavity a variable volume that houses one of the contacts; this volume expands rapidly when the heat from the arc striking in the opening is transferred to the gases contained therein, and which is vented to the atmosphere in a particular position of the screen where the openings no longer meet the contact.

BRIEF DESCRIPTION OF THE DRAWINGS

Other additional results, such as a reduction of the weight of the mobile system coupled to the screen for a given volume of the cavity in which the arc appears, as well as different embodiments enabled by the invention will be better understood from the following description with reference to the drawings attached, in which.

DESCRIPTION OF THE PREFERRED EMBODIMENT

In all the devices described hereafter, the pressure of the gases developed at the moment when the arc strikes is applied to an insulating mobile driving shutter which is coupled to a mobile screen and which at that moment, encloses a practically airtight volume or space with the walls of the housing.

In the embodiments shown, where the switch mobile contact is housed in this space, it is essential that the latter be sized so that the motion of the mobile contact is broad enough for the purpose at hand. One of the ways to decrease the amount of moving weight is to enclose this volume by walls with as little possible movement and weight; this reduction is conveniently effected by making an area of the wall acting as a driving shutter practically fixed, particularly by means of a rotating seal; attractive friction reduction can also be obtained this way.

Figure 4:
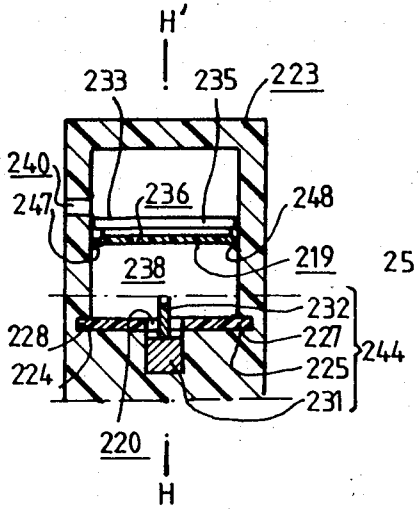
FIG. 4 shows a side view of the apparatus as per FIG. 3 cut away by broken plane WW'.
Figure 3:
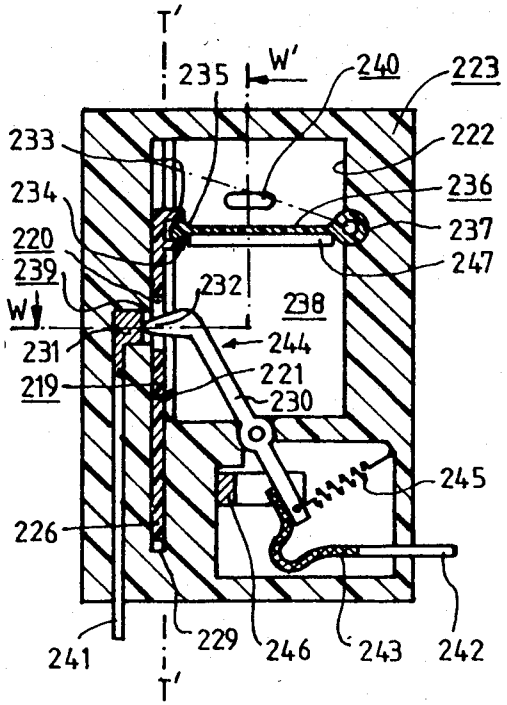
FIG. 3 illustrates an elevation cut away by plane HH' of a second embodiment of the invention.

An embodiment in which the variable volume is not comprised between walls belonging to a hollow or tubular sheath is visible in FIGS. 3 and 4, where a flat insulating screen 219 with an opening 220 can slide on a surface 221 belonging to a cavity 222 of an insulating housing 223; lateral edges 224, 225, see FIG. 4, and a rear portion 226 of the screen fit with a functional clearance in grooves 227, 228, 229 of the cavity so that when the screen moves upwards in FIG. 3, total electric insulation is ensured between the cavity, housing a mobile contact lever 230 the contact pad 232 of which passes through the opening, and a fixed contact 231 which is recessed from surface 221.

An edge 233 of the screen, directed towards the cavity, features coupling devices 234 able to cooperate with the edge 235 of a shutter 236 which pivots at the other end around an axis 237. This end, this pivot axis, as well as the lateral edges 247, 248 of the shutter mate tightly with the cavity walls and as applicable with the screen; as a result an electric arc striking between the parting contacts causes a pressure rise within the variable volume 238 of the cavity where the mobile contact is which is fast enough to ensure that the screen is driven very quickly upwards in the figure by the shutter and shears the arc between the opening 220 and an edge 239 of surface 221.

An outlet 240 that passes through the housing to the cavity ensures venting of the variable volume in a particular position of the shutter. Terminals 241, 242 and a flexible braid 243 are provided to connect the switch 244 to a load circuit. A contact pressure spring 245, and an overcurrent sensing device 246 (e.g. a U-shaped magnetizable part) exert for instance antagonistic stresses on the mobile contact lever, and when the overcurrent occurs, the contact lever is suddenly driven clockwise, giving rise to an arc.

Figure 5:
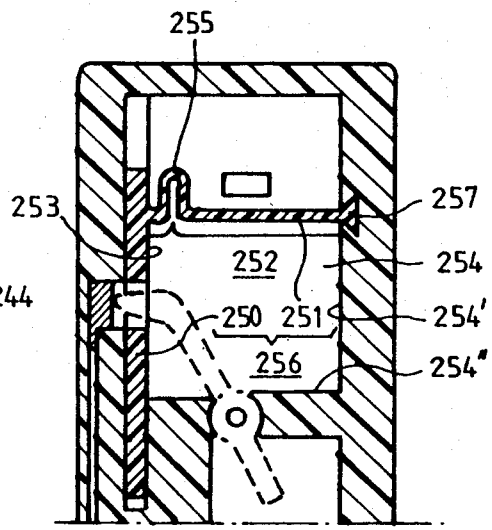
FIG. 5 shows a partial elevation of a breaking chamber in a switching device as per the invention involving a variation of the one shown in FIG. 3.

In one alternative, visible in FIG. 5, screen 250 and shutter 251 could be molded as a single insulating part 256, whilst in this case the variable volume 252 is enclosed between rigid screen walls 253 and as applicable 254, 254', 254'' of the housing, and a deformable wall of the shutter 255 is embedded at one end in the housing to form an exposed pivoting axis 257.

Obviously a switching device could also be obtained by means of a symmetrical association about the plane TT' in FIG. 3 of two mobile contact levers leaning against each other and designed to separate in the same way.

In the embodiment described in FIGS. 3, 4, 5, it may be feared that gas pressure exerted on the screen presses it too hard against the neighbouring surface, hence checking or slowing down the motion.

Figure 1:
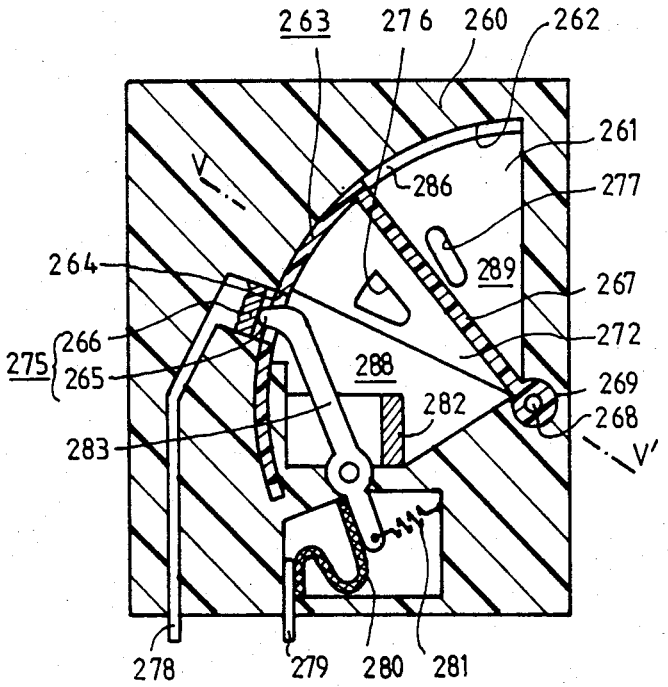
FIG. 1 shows, an elevation cut away by a central plane JJ' of a first embodiment of the invention.
Figure 2:
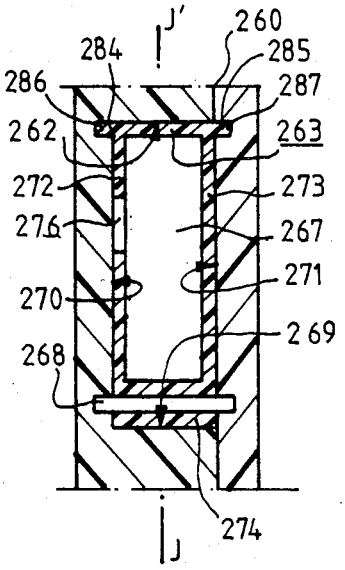
FIG. 2 shows a side view of the unit as per FIG. 1 cut away by a plane VV'.

This drawback can be eliminated by shaping the screen as a portion of cylinder supported and pivoted by means of the shutter, as shown in FIGS. 1 and 2, where an insulating housing body 260 features a cavity 261 with a cylindrical surface 262 in front of which a screen with the same curved outline 263 moves angularly with a very close fit, provided with an opening 264 so that in its resting position, it lets through a mobile contact 265 that mates with the fixed contact 266 suitably located.

This rigid screen is joined to a radial shutter 267 which is hinged on a transversal pivot 268 placed in the centre of curvature of surface 262 and which provides a tight enough seal with the other walls 269, 270, 271 of cavity 261, thanks to flanges 272, 273 and a hub 274, see FIG. 2; as a result the gases, the pressure of which rises within the variable volume 288 when the arc strikes following the opening of the switch 275, drive the shutter clockwise; here again, decompression openings such as 276 in a flange of the shutter coincide with a vent 277 in the housing cavity in a particular position of the screen.

As in the previous embodiment, terminals 278, 279, a braid 280, a pressure spring 281 and automatic opening means such as 282 are associated with contact lever 283; on the other hand, screen sealing is improved by tangent edges 284, 285 which slide in grooves 286, 287 on the housing.

Obviously, although for the sake of clearness they have not been drawn, devices are provided to return screens 263, 219, 250, after opening to an identical position as the one pictured, and a vent is provided for the gases which otherwise would be entrapped between the screens and the areas where the fixed contacts are located. A purge opening to the atmosphere must also be provided on the portion of cavity located in front of the screen such as 289, to avoid motion checking.

In the embodiments illustrated above, the initial movement of the mobile contact levers, which occurs shortly before the shutter and the screen start moving, and which generates the arc the energy of which is used, is assumed to be caused by a magnetizable structure 246, as applicable 282, the efficiency of which is certain when current flowing in the lever is very high and when other magnetic operating devices are liable to be saturated.

Coils can be connected in series and associated with cores or rapid mobile frames, so that when current levels are high but not as much as above, these moving parts ensure the initial opening of the various mobile contacts.

For on-load switch opening under rated current, e.g. in order to isolate the line, the screen can be made to move or not to move, depending on whether it is required or not by the energy released by the arc and circuit opening quality wanted.

What is claimed is:

1. A switch containing inside a housing two mutually mobile contacts, devices to control the opening of this switch, a mobile screen and driving devices designed to move an edge of this screen very fast between the contacts so that the arc that strikes between these contacts when they part is sheared between the screen edge and an insulating surface contained in the housing, characterized in that the screen provided with an opening that lets through one of the switch contacts and an insulating mobile shutter to which it is joined, move at the same time inside a cavity of the body, so as to enclose between themselves and the surfaces of this cavity a variable volume that houses one of the contacts; this volume expands sharply when the energy of the arc generated between parting contacts is transferred to the gases contained within the volume, and is connected to the atmosphere in a particular position of the screen where the opening no longer lets the contact through.

2. Switch according to claim 1, characterized in that the screen and the shutter are both part of one single insulating part.

3. Switch according to claim 2, wherein the screen moves in a straight line and limits the variable volume.

4. Switch according to claim 2, characterized in this this wherein said single insulating part has a pivoting movement and features a shutter one end of which oscillates with a seal around a pivot inside the cavity.

5. Switch according to claim 1, wherein the screen that moves in a straight line and the shutter that has an angular movement are joined by a sealed coupling device.

* * * * *